United States Patent [19]

Case

[11] 4,046,178

[45] Sept. 6, 1977

[54] FLOATING BAG FOR POLLUTION STUDY

[75] Inventor: John N. Case, Victoria, Canada

[73] Assignee: Case Existological Laboratories, Ltd., Victoria, Canada

[21] Appl. No.: 729,973

[22] Filed: Oct. 6, 1976

Related U.S. Application Data

[63] Continuation of Ser. No. 579,075, May 19, 1975, abandoned.

[51] Int. Cl.[2] ..... B65B 3/04

[52] U.S. Cl. ..... 141/1; 141/10; 141/114; 61/1 R; 61/69 R; 137/236

[58] Field of Search ..... 141/1, 10, 114; 9/8; 138/114; 114/.5 R, .5 T; 61/1, 46.5, 69 R; 137/236, 566; 47/1 R; 260/40, 448.2 R

[56] References Cited

U.S. PATENT DOCUMENTS

| | | | |
|---|---|---|---|
| 3,098,246 | 7/1963 | Pekor et al. | 138/114 |
| 3,230,967 | 1/1966 | Castro | 137/236 |

*Primary Examiner*—Houston S. Bell, Jr.
*Attorney, Agent, or Firm*—Wenderoth, Lind & Ponack

[57] ABSTRACT

A method of deploying a floating bag for observing marine life in a natural but controlled environment. The water level in the bag is slightly higher than the level of the water in the bag to maintain turgidity and stabilize the deployed bag. Also, the bag can easily be filled with water, substantially without the use of pumps.

3 Claims, 2 Drawing Figures

FLOATING BAG FOR POLLUTION STUDY

This is a continuation of application Ser. No. 579,075, filed May 19, 1975.

FIELD OF THE INVENTION

This invention relates to floating bags, for use, for example, for pollution study.

DESCRIPTION OF THE PRIOR ART

It is known to dispose flexible, floating bags in marine or like environments for study of conditions in a confined body of water. Such bags, due to their nature, are also suitable for containing bodies of liquid for a variety of purposes, such as the temporary storage of recovered oil spills, the storage of sewage, or the maintenance of a given life cycle under controlled but natural conditions. The primary value of the use of a floating bag is that the strength required in the bag for the storage of liquid is far less than the strength required for the storage of a similar body of liquid above water level since the pressure of the liquid stored within the bag is equalized by the pressure of the body of water outside the bag.

It is a problem with such bags, for whatever purpose they are used, that they are inherently unstable in that the medium in which they are stored, typically the marine environment, often subjects the bag to considerable stress due, for example, to cross currents and other conditions obtaining in the body of water in which they are stored. Thus, in the case of a bag which may for example be six or seven fathoms deep, if the current on the surface moves in a different direction from the current below the surface, the bag becomes distorted and may lose some of its contents or otherwise become unsuitable for the purpose for which it is intended. This is particularly true when persons operating from the surface are attempting to take samples of the fluid contained within the bag at varying depths.

SUMMARY OF THE INVENTION

According to the present invention, there is provided a method for deploying floating bags that solves the above problems. There is also provided a method for capturing a column of water in such bags in those cases where the fluid to be stored is the same as the fluid in the body of water in which the bags are deployed.

Accordingly to the invention, the bag is formed from a material that is relatively resistant to stretching. When it is deployed, for example in the ocean, there is maintained within the bag a water level slightly higher than the level of the water in the surrounding marine environment. This has the surprising result that the bag becomes turgid and resists distortion such as that caused by the above mentioned cross currents. Bags deployed by the method according to the invention, therefore, are inherently more stable than bags deployed by other methods. According to another aspect of the invention, a column of water may be captured in bags of the above type in a very simple, economical and speedy manner.

Dealing with the last mentioned aspect of the invention, conventional methods provide for the filling of deployed bags with water from the surrounding marine environment by pumping water into the floating bag. This takes a substantial amount of time, and requires the use of expensive pumping equipment and careful supervision. According to the present invention, a bag may be substantially filled with water without the use of pumps and in a substantially reduced time compared with the filling of the bag exclusively by use of pumps.

Given that there is to be filled with water from a marine environment a bag of, for example, forty feet in depth, a collapsed bag provided with floats around its mouth is taken down, for example by a diver, to the point at which the mouth is forty feet or so below the surface of the water. The bag is then released. Due to the floats in the mouth, the bag instantly rises to the surface, expanding as it does so and becoming filled with water. When the bag reached the surface, it will be substantially filled with water. It can then be attached to a suitable float means and the differential head mentioned above created by the pumping in of a marginal amount of extra water to raise the level of the water within the bag to a level slightly above the level of the surrounding environment.

An embodiment of the invention will now be described with reference to the accompanying drawings, in which:

DETAILED DESCRIPTION

Since the present invention relates to methods as opposed to structure, it should be understood at the outset that the illustrations and the following description of the structure are for the sake of illustration only and in no way are intended to limit the scope of the invention claimed herein.

Figure 1:
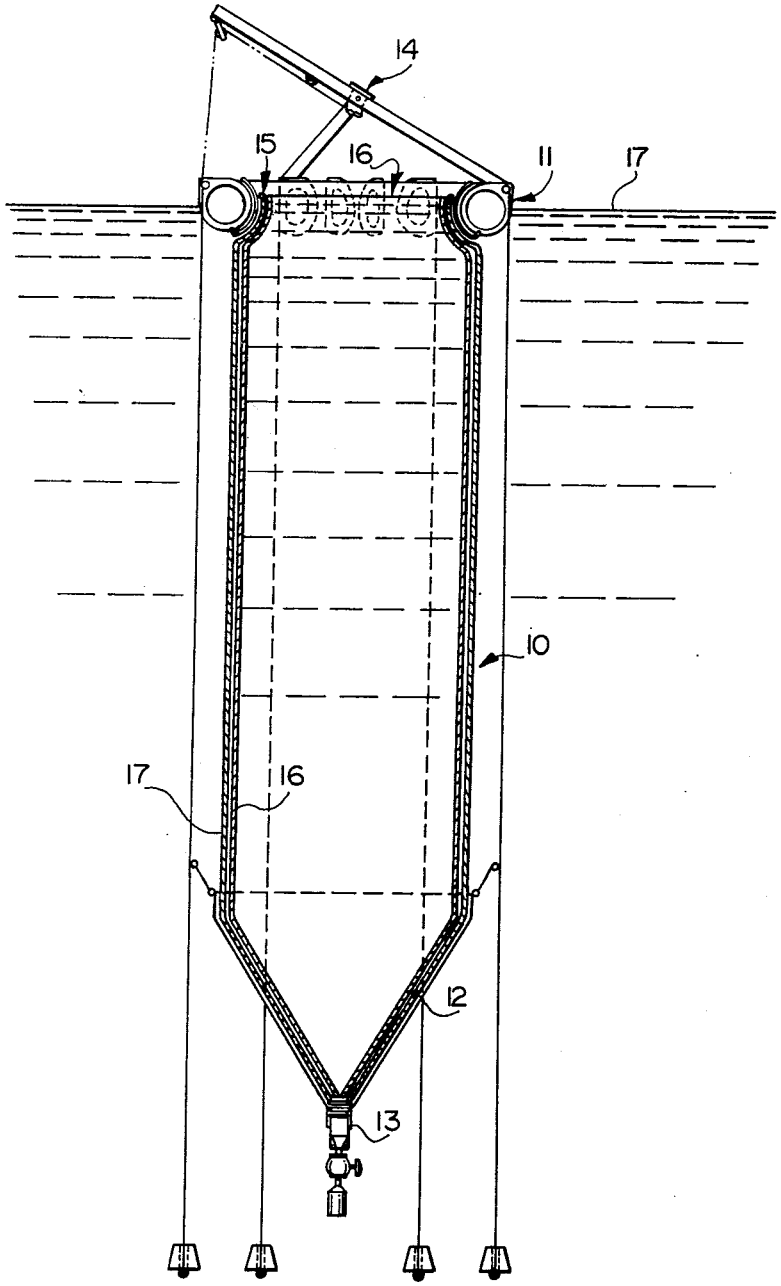
FIG. 1 is a cross section of a deployed bag that has been filled according to the method of the invention.
Figure 2:
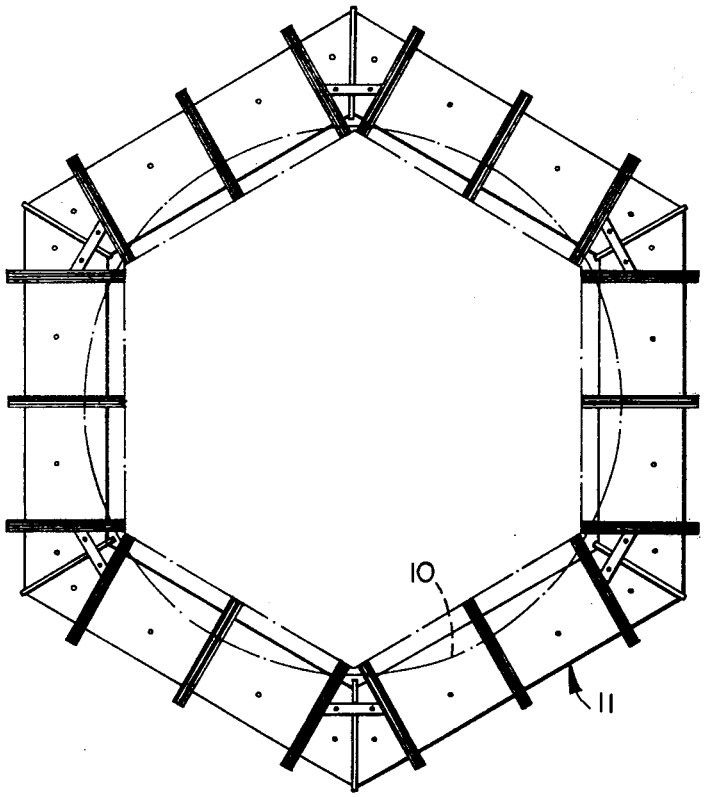
FIG. 2 is a plan view of the bag shown in FIG. 1.

In FIG. 1, there is shown a typical bag that is intended for use in the study of the effects of pollution on a selected portion of a marine environment The bag 10 is shown supported by a flotation module 11 to which the bag 10 is releasably attached by suitable means, such as hooks, or any conventional suitable type of fastening means especially of the type that is capable of absorbing shock. Under certain conditions, a shock-absorbing attachment may be essentail to prevent damage to the bag resulting from violent movement of the flotation module caused, for example, by rough seas. Normally, the bag 10 is attached to a module 11 separably such that the two components can be separated from each other, but such detachable attachment is not absolutely essentail for the successful operation of the invention.

The flotation module 11 naturally should provide sufficient bouyancy for the whole structure that even though the water level within the bag is higher than the water level of the surrounding environment, there will remain between the top of the module 11 and the surrounding environment sufficient clearance to prevent substantial migration of water from within the bag to the outside or of water from the surrounding environment into the bag. For this purpose there may be provided a weir or the like projecting above the level of the top of the module 11. Further, and for the successful maintenance of the higher water level, of "differential head" between the inside of the bag and the surrounding environment, the bag itself should be sufficiently resistant to stretching that it will not readily deform outwardly due to the increased water pressure within the bag relative to the water pressure outside the bag resulting from the higher water level within the bag. Thus the bag may be, as illustrated, a two layer structure, the inner portion 16 being formed of translucent polyethylene and the outer layer 17 being a woven translucent polyethylene. Other suitable fabrics, obviously can be used so long as the above conditions are met, i.e., of resistance to stretching.

For the purpose of illustration, the bag is shown as a generally cylindrical structure with a conical portion at the bottom. The conical portion 12 is provided, at the apex of the cone, with a sampling means 13 that will permit withdrawal of samples from the bottom of the gab. Also, there may be provided above the module 11 a winch or like structure 14 whereby a sampling bottle may be lowered to various levels within the bag to permit withdrawal of samples.

The module 11, in the ullustrated embodiment, is a six sided structure formed from tubular sections of a clear acrylic material, joined together by adhesive, or other fastening means, to form a water-tight unit that is relatively stiff. The use of a clear acrylic material both for the module 11 of translucent material for the bag 10 will prevent shadows that might change the characteristics of the captured column of water in the bag.

As mentioned above, the bag may be detachably attached to the flotation module 11 in such a manner that the bag can readily be separated from the flotation module. Thus, around the neck of the bag, at 15, there may be attached a peripheral rope that enables the fastening of the bag to the flotation module 11. The peripheral rope 15 may, however, be replaced by a bouyant means, such as a sealed tube, that will serve both for achieving the result described below and for attachment of the bag to the flotation module 11.

As mentioned above, the bag may be easily filled with water by a method that does not involve the exlusive use of pumps. Under these circumstances, it is necessary for some type of flotation means to be provided around the neck of the bag. This may be tubular means, inherently bouyant, as described immediately above, or may comprise any means sufficent to give to the neck of the bag a degree of bouyancy sufficient to cause it to rise to the surface.

In deploying a bag of the type illustrated, the bag in collapsed condition is taken below the surface of the water to a depth approximately equivalent to the total length of the bag. This may be done by a diver, or by means responsive to water pressure that automatically release at a selected depth. This is achieved by first locating the flotation module 11 at the surface at the location at which it is desired to sample the water. The bag is then taken down, in collapsed condition, to a depth equivalent at least to the length of the bag. The mouth of the bag is located directly below the flotation module 11, The mouth is then released, and due to its bouyancy, rises to the surface and engages the flotation module 11. By the time the bag reaches the surface, it is substantially filled with water and can immediately be attached to the flotation module by the above-described fastening means. It has been found that when this method is used, approximately 90% of the water required for filling of the bag is contained within the bag. This method has the highly desirable result that the water within the bag represents a true cross section of the water between the flotation module and the point at which the bag was released below the surface. This is particularly useful when it is desired to sample and observe a true cross section of a given body of water. By this means, therefore, the undesirable result is avoided that when water is pumped into a bag of this type, the water that ultimately fills the bag will not represent a true cross section of the marine environment that is being sampled.

After the bag has been deployed in the above manner, it is only necessary to pump in a small amount of water to bring the water level within the complete structure up to the point desired, i.e. slightly above the level of the surrounding body of water. The water level spoken of here is shown in FIG. 1 at 16 and it will be noted that this level is slightly higher than the level of the surrounding body of water 17.

What I claim as my invention is:

1. A method of filling a bag for deployment in a fluid environment comprising the steps of (1) providing the bag around its mouth with bouyant means, (2) placing te bag, in collapsed condition, at a distance below the surface of a body of fluid corresponding to the distance through which it is desired to take a sample, and (3) releasing the bag so that the mouth thereof floats to the surface, to capture a column of fluid in the bag.

2. A method as defined in claim 1 wherein the bag, after it has reached the surface, is secured to a flotation module.

3. A method of deploying a fluid filled bag in a marine or like environment, comprising providing a bag of a flexible material hving a resistance to stretching, supporting the bag from the surface of the water by flotation means, and raising the level of the fluid within the bag to a level slightly above the level of the fluid in the bag at which the fluid within the bag and the water around the bag are in equilibrum for maintaining turgidity in the total structure so as to resist disturbance of the bag due to variations in the conditions in the environment in which the bag is deployed.

* * * * *